United States Patent [19]

Kotke

[11] Patent Number: 4,595,313

[45] Date of Patent: Jun. 17, 1986

[54] BOAT HOIST

[76] Inventor: Edwin J. Kotke, Rte. 1 Box 191 A, Sarona, Wis. 54870

[21] Appl. No.: 572,501

[22] Filed: Jan. 20, 1984

[51] Int. Cl.[4] ..... B63C 3/00; B63C 3/08; B66B 9/20

[52] U.S. Cl. ..... 405/2; 405/3; 187/10; 414/678

[58] Field of Search ..... 405/1–4, 405/7, 221; 114/44, 45, 48, 344, 368, 375; 254/88; 414/678; 187/8, 59, 10, 12, 20; 182/36, 103, 144

[56] References Cited

U.S. PATENT DOCUMENTS

| | | | |
|---|---|---|---|
| 683,890 | 10/1901 | Wolfe | 187/10 |
| 1,537,800 | 5/1925 | Chapman . | |
| 1,710,442 | 4/1929 | Warshaw | 187/8.59 |
| 3,220,196 | 11/1965 | Schollard | 61/65 |
| 3,238,733 | 3/1966 | Kreis | 405/2 |
| 3,265,024 | 8/1966 | Kramlich | 405/3 X |
| 3,592,294 | 7/1971 | Allen | 182/103 X |
| 3,675,258 | 7/1972 | Osmundson | 9/34 |
| 3,697,048 | 10/1972 | Sarno | 254/148 |
| 3,891,062 | 6/1975 | Geneste | 187/10 |
| 3,895,592 | 7/1975 | King | 114/45 |
| 3,985,207 | 10/1976 | Petit | 187/8.59 X |
| 4,022,027 | 5/1977 | Tetzner | 61/65 |
| 4,027,492 | 6/1977 | Carpenter | 61/65 |
| 4,072,119 | 2/1978 | Williams | 114/45 |
| 4,109,896 | 8/1978 | Ragen | 254/144 |
| 4,236,859 | 12/1980 | Stears et al. | 414/460 |
| 4,279,565 | 7/1981 | Verdy | 414/678 |
| 4,329,082 | 5/1982 | Gillis | 114/48 X |
| 4,391,550 | 7/1983 | Rutter | 405/7 |
| 4,401,335 | 8/1983 | Godbersen | 294/84 |

FOREIGN PATENT DOCUMENTS

| | | | |
|---|---|---|---|
| 2477099 | 9/1981 | France | 405/2 |

*Primary Examiner*—Cornelius J. Husar
*Assistant Examiner*—Nancy J. Stodola
*Attorney, Agent, or Firm*—Richard Francis

[57] ABSTRACT

A boat hoist has a frame with forward part including spaced upright posts, a rearward part including spaced upright posts, spaced to permit the passage of a boat therebetween, and an inclined track assembly attached to the frame between the pairs of spaced upright posts, a boat platform mounted for movement up and down of the track assembly, means for moving the boat platform upward along the track assembly, means for moving the boat platform downward along the track assembly, and means for holding the platform at a lower position and at an upper position on the track assembly. The hoist requires much less effort to lift and lower a boat because of the inclined plane and provides a convenient safer means of removing the boat from the water.

9 Claims, 4 Drawing Figures

BOAT HOIST

BACKGROUND OF THE INVENTION

The present invention relates generally to boat hoists and more particularly to a boat hoist employing a platform which is movable on an inclined plane to raise and lower the boat.

Mechanical hoists are commonly employed for elevating motor boats, launches, sailboats, pontoons, and other relatively small water craft out of the water when not in use so that they will not be buffeted by the wind and waves and knocked against an adjacent pier or dock, which can result in damage to the boat.

Examples of prior art hoists of the general type herein concerned are disclosed in the following U.S. Patents:

U.S. Pat. No. 4,109,896 describes a hoist having a scissor type lifting mechanism;

U.S. Pat. No. 4,401,335 describes a boat hoist including a vertically movable platform;

U.S. Pat. No. 3,697,048 describes a boat hoist having an arcuate lifting member positioned beneath the bow and stern portions of the boat;

U.S. Pat. No. 4,279,565 describes a hoisting apparatus having a sling type arrangement;

U.S. Pat. No. 4,022,027 describes a lifting frame including a winch for raising the boat above a freeze zone of a body of water;

U.S. Pat. No. 4,236,859 describes a mobile hoist including loading slings;

U.S. Pat. No. 4,391,550 describes a boat lift having opposed flotation tanks and a gunnel support system;

U.S. Pat. No. 4,027,492 describes a transportable boat lift including a collapsible framework;

U.S. Pat. No. 3,895,592 describes a boat lift which includes a float of polyurethane material;

U.S. Pat. No. 3,675,258 discloses a dock-mounted boat hoist which includes a scissor-type extensible and retractable arm assembly;

U.S. Pat. No. 3,220,196 discloses a boat dock which is used to raise boats from and lower boats into the water; and U.S. Pat. No. 4,072,119 discloses a vertical raising boat lift.

While, as indicated above, there are numerous devices for lifting or hoisting boats in and out of the water, none discloses incorporating a platform movable on an inclined plane to provide a mechanical advantage in the lifting and lowering arrangement, even though the principle of using an inclined plane for mechanical advantage is well known, for example, as long ago as 1925, in an automobile hoist as shown in U.S. Pat. No. 1,537,800.

SUMMARY OF THE INVENTION

The boat hoist of the invention includes a frame having a forward part including a first pair of spaced upright posts and a rearward part including a second pair of upright spaced posts. The frame has a lower part for support on the bottom of a body of water. Preferably the posts are sufficiently long so that their upper ends protrude from the surface of the body of water. The posts in the forward and rearward parts are spaced apart to permit the passage of a boat therebetween. An inclined track assembly, attached to the frame between the pairs of posts, includes spaced opposed parallel tracks deployed at an angle between about 10° and about 45°0 from the horizontal. A boat platform is mounted for movement along the track assembly between a lower position on the track assembly to permit a boat on the surface of the body of water to float over the platform and an upper position on the track assembly where at a boat being supported on an upper boat-receiving surface of the platform will be prohibited from floating on the surface of the body of water. The hoist also includes a means for moving the boat platform downward along the track assembly and a means for moving the boat platform upward along the track assembly. Also included is a holding means for holding the boat platform at the lower position and at the upper position. In a preferred embodiment, a counter weight is connected by a suitable cable and pulley arrangement to the platform to urge the platform into an upper position. The platform preferably includes a flotation panel formed of a highly buoyant material and, as such, it will provide a unique lifting force to keep a boat contained thereon above the surface of the water.

DESCRIPTION OF THE PREFERRED EMBODIMENT

Figure 1:
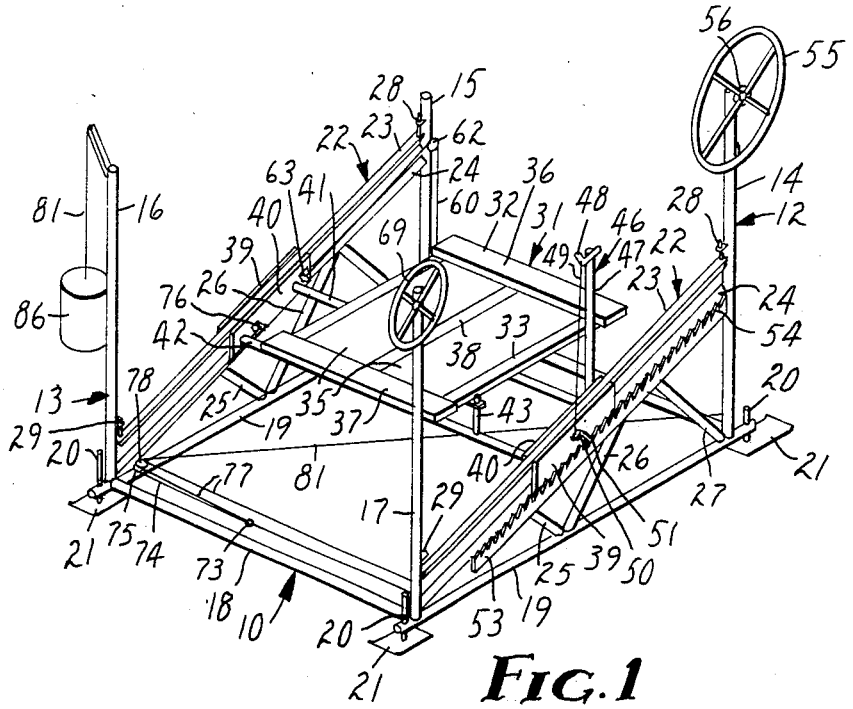
FIG. 1 is a perspective view of the boat hoist of the invention.
Figure 2:
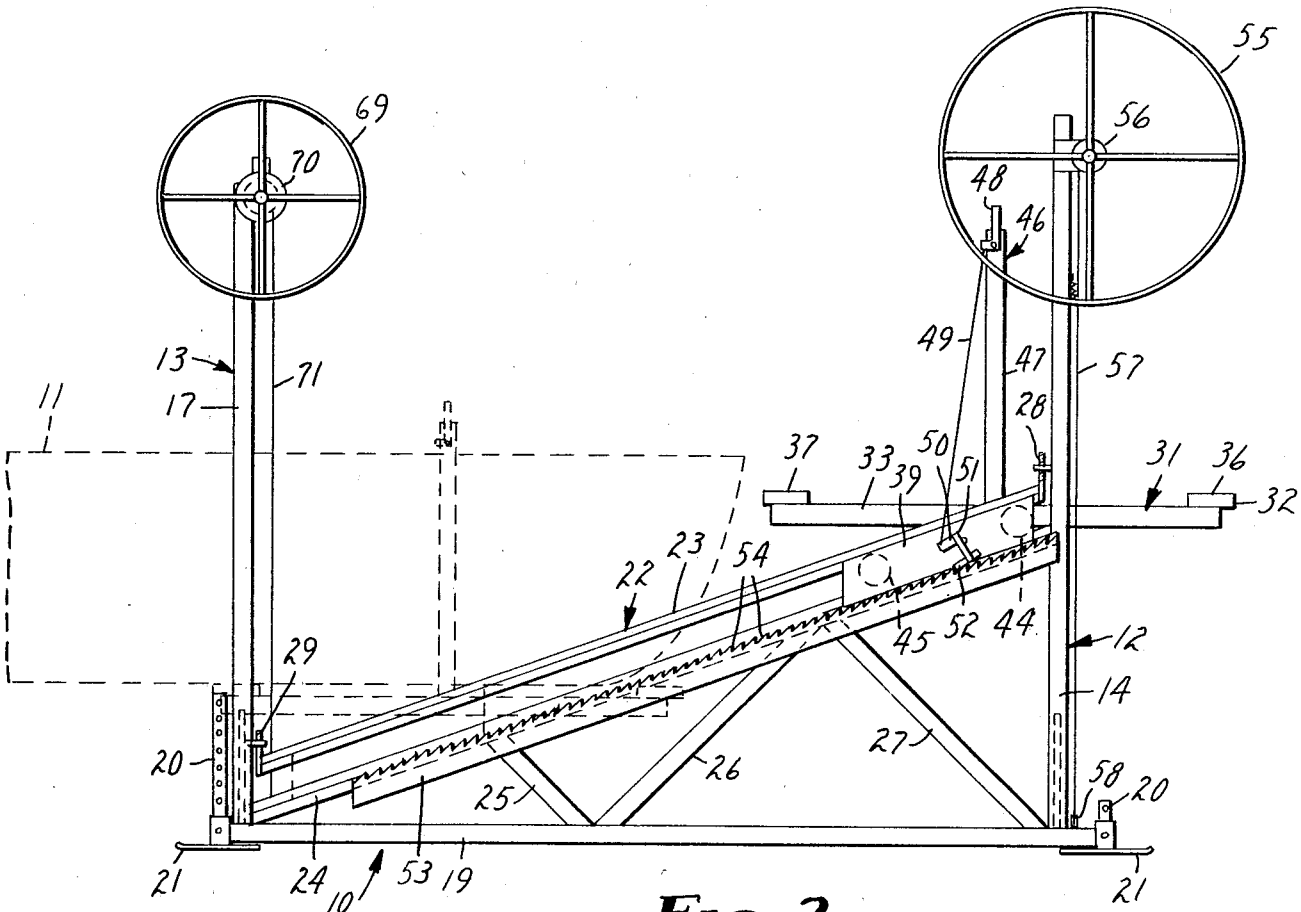
FIG. 2 is a side elevational view showing the boat hoist with a boat shown on the boat receiving platform (both being shown in broken line) in a lower position and the boat platform (shown in full line) in an upper position.
Figure 3:
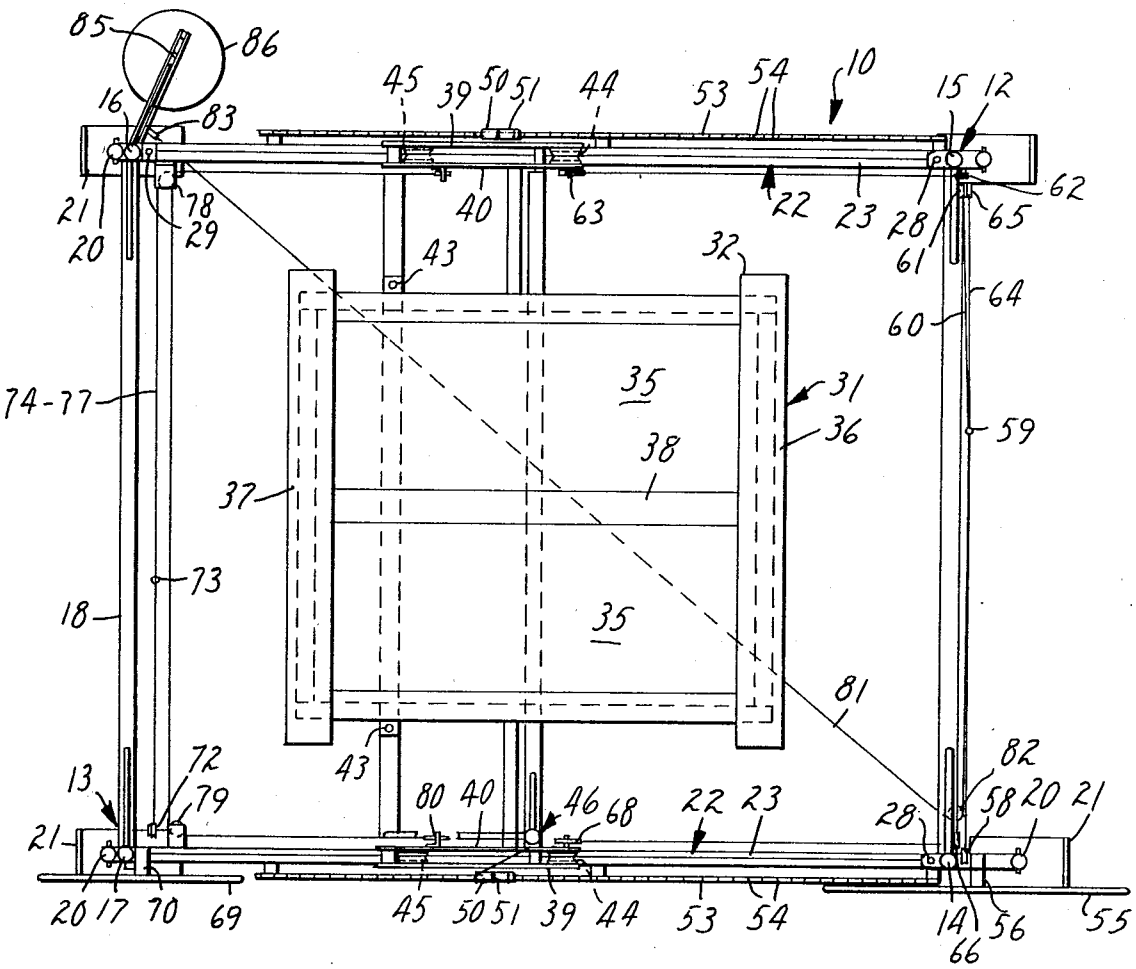
FIG. 3 is a top plan view of the boat hoist of the invention.

Referring now more particularly to FIGS. 1–3 of the drawing, the boat hoist of the invention is designated generally by the numeral 10, and in FIG. 1 hoist 10 is shown supporting a boat 11 on a boat-receiving platform 32 (both in broken line) in its lower or boat receiving position and with platform 32 (full line) in the raised or elevated position.

It is to be understood, incidentally, that while the present invention is particularly well adapted for use with motor boats, pontoons, launches, sailboats and other relatively small craft, the novel hoist could also be advantageously utilized for handling larger boats as well, and the invention is by no means limited in this respect. Similarly, while hoists of the type herein concerned are ordinarily installed adjacent a pier or dock or the like, to permit raising of the boat out of the water to provide a safe mooring, the hoist may be installed wherever desired by the user.

As seen in FIGS. 1–3, the hoist frame includes a forward open frame part 12 which includes spaced upright corner posts 14 and 15 and a rearward part 13 which includes spaced upright corner posts 16 and 17. The posts in the forward part and the rearward part are spaced apart to permit the passage of a boat therebetween. The frame also includes structural members, as necessary, such as forward and rearward base frame members 18 and side frame members 19. The frame preferably also includes adjustable members 20 which preferably include a base plate or foot member 21 mounted on a shaft which is adjustably movable within an opening in a corner part of the frame such as in an extending part of side frame member 19 to adjust the height or level the frame.

The frame further includes an angled track assembly 22 having a lower end preferably fastened adjacent rearward frame part 13 and upper end preferably fastened near forward frame part 12. Angled track assembly 22 preferably includes upper track 23 and lower track 24 on either side and appropriate angled struts 25, 26 and 27 for support. Upper track 23 may be attached to the frame by a suspended bolt arrangement 28 and 29 respectively at the upper and lower ends to permit adjustment of upper track 23 so that it is completely parallel with lower track 24.

Boat platform assembly 31 includes boat platform 32 comprised of platform frame 33 and panel 35, which is preferably a float panel, forward and rearward boat support members 36 and 37 on the platform leading and following ends, and a transverse support member 38. Float panel 35 may be provided by any durable flotation article of the appropriate shape, such as a rectangular piece of foamed plastic material. Boat support members 36 and 37 may be shaped to accommodate the bottom part of the particular shape of the boat or pontoon being lifted. Boat platform assembly 31 is carried by angled track assembly 22 on upper platform support member 41 and lower platform support member 42 which are fitted at opposite ends through inner plate 40 and outer plate 39 which therebetween hold upper slotted wheel 44 and lower slotted wheel 45, each having a peripheral slot adapted to fit upper rail 23 and lower rail 24 for movement therebetween. Rails 23 and 24 are parallel and positioned to permit easy movement of slotted wheels 44 and 45 thereon and the slots of the wheels are of a sufficient depth to prevent removal of the wheels from the rails. Preferably, platform frame 33 is fitted with angle adjustment bolts 43 which are fixed to lower platform support member 42 which permit adjustment of the deployment of platform 32 to be horizontal or any other desired angle within the adjustment range. For example, platform 32 may be tilted so that a boat carried thereon has its end containing the drain downward to permit drainage of water from the boat.

Angled track assembly 22 includes a means for holding platform 32 at a fixed position on the angled track. Such means is preferably provided by lever support arm 47 (attached to platform 32) to which lever 48 is attached and has fixed to one end of cable 49 having its lower end attached to weighted pawl 50 (pivotally attached to one inner plate 40) which includes an upper weighted portion 51 and an engaging portion 52 for engagement with the teeth 54 of rack bar 53. When lever 48 relaxes cable 49 engaging portion 52 of weighted pawl 50 engages the teeth 54 of rack bar 53.

Figure 4:
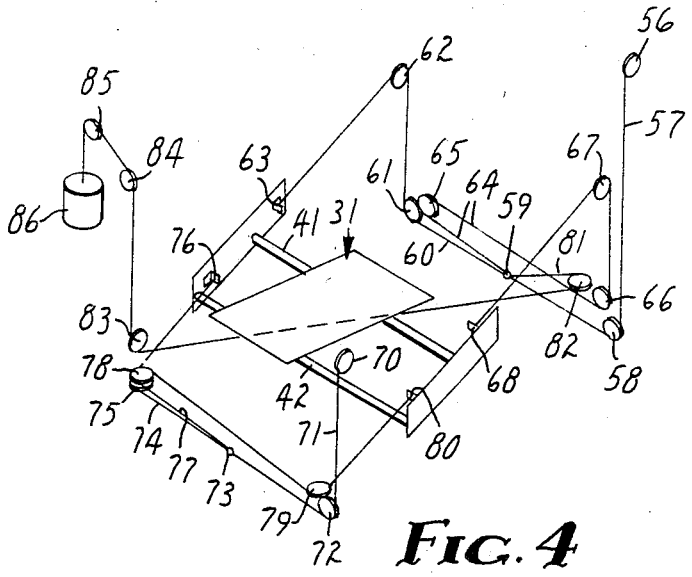
FIG. 4 is a schematic view showing the detail of the lifting cables and pulleys in combination with the movable platform.

Platform 32 is moved upward along the track assembly by cables which are caused to move by front hand wheel 55, which is preferably attached at the top end of a corner post, e.g., 14, which has associated therewith front winch pulley or cable drum 56 which, as shown in greater detail in FIG. 4, is capable of winding thereon and unwinding cable 57 which passes over pulley 58 and is attached by cable connector 59 to cables 60, 64 and 81. Cable 60 passes over pulleys 61 and 62 and is attached to an upper part of platform assembly 31 at adjustable cable connecting bolt 63. Cable 64 passes over pulleys 65, 66 and 67 and is attached at the other side of the upper part of platform assembly 31 at adjustable cable connection bolt 68. As hand wheel 55 winds cable 57 onto cable drum 56, simultaneous pulling action occurs on the upper portion of platform assembly 31, causing it to raise.

Cable 81 is also attached to cable connector 59 and is deployed over pulleys 82, 83, 84 and 85 and attached to counter weight 86 which applies a lifting force on platform assembly 31, tending to keep it in an upward position. Preferably, wheel 55 includes a spring stop which frictionally rides on the inside of the hand ring part of wheel 55 to prevent undesirable rapid movement of platform assembly 31. Wheel 55 may also be geared to provide a mechanical lifting advantage and to slow movement.

Platform assembly 31 is lowered by an appropriate cable and pulley assembly including rear hand wheel 69 which is preferably mounted at the top of post 17 and turns rear winch pulley or cable drum 70 raising and lowering cable 71 which passes over pulley 72 to cable connector 73. Cables 74 and 77 are also attached to cable connector 73. Cable 74 passes over pulley 75 and is connected to the lower portion of platform assembly 31 at adjustable cable connecting bolt 76. Cable 77 passes over pulleys 78 and 79 and is attached at the opposite side of platform assembly 31 at adjustable cable connecting bolt 80. Rear hand wheel 69 preferably includes a means for holding cable drum 70 in a particular position, e.g., by a rachet and pawl arrangement (not shown).

Posts 14, 15, 16 and 17 may be of any convenient height, diameter and cross-section so long as they provide the necessary support. Preferably, the posts are 6½ feet in height. Platform frame 33 is preferably formed of 2 inch ×2 inch square tubing and panel 35 is preferably 2 inches thick by 4 feet by 4 feet. Expanded rigid closed-cell polymeric foams provide suitable float panels but other flotation materials may also be used.

The angle of angled track assembly 42 is preferably 10° to 45°, most preferably 20°.

Counter weight 86 may be provided by a 12 inch diameter 16 inch high concrete cylinder, but any other suitable weight will also do.

The size of the elements forming the boat hoist of the invention and the particular materials from which it is formed should be selected, depending upon the size and weight of the boat with which it will be used and upon the conditions of use. Such a selection is well within the capability of one skilled in the art. Various modifications maybe made in the boat hoist described above without departing from the scope of the claims.

I claim:

1. A boat hoist, comprising:

a frame having a forward part including a first pair of spaced upright posts, a rearward part including a second pair of upright spaced posts, the posts in said forward and rearward parts being spaced apart to permit the passage of a boat therebetween, an inclined track assembly attached to said frame between said pairs of posts and including spaced opposed parallel tracks deployed at an angle between about 10° and about 45° from the horizontal, said hoist being positionable in a body of water with a lower portion of said track assembly in the body of water and an upper portion of said track assembly above the surface of said body of water; and a boat platform having a boat-receiving upper surface mounted for movement along said track assembly between a lower position on said track assembly to permit a boat on the surface of said body of water to float over said platform on said track assembly and an upper position on said track assembly where at a boat being supported on said upper boat-receiving surface will be prohibited from floating on the surface of said body of water;

means for moving said boat platform downward along said track assembly;

means for moving said boat platform upward along said track assembly; and means for holding said boat platform at said lower position and at said upper position.

2. The boat hoist of claim 1, wherein said means for moving said boat platform upward along said track assembly includes:

a cable drum; and a cable having a predetermined length having one end windably attached to said cable drum and an opposite end attached over an appropriate pulley arrangement to the upper end of said boat platform.

3. The boat hoist of claim 1, wherein said means for moving said boat platform upward along said track assembly includes:

a cable drum;

a first cable having a predetermined length having one end windably attached to said cable drum and an opposite end over an appropriate pulley arrangement to a cable connector; and a pair of cables of predetermined length attached over appropriate pulley arrangements to the upper end of said boat platform.

4. The boat hoist of claim 3, wherein said means for moving said boat platform upward along said track assembly further includes:

a cable having a predetermined length having one end attached to said cable connector and an opposite end attached over an appropriate pulley arrangement to a counter weight, said pulley arrangement being such that counter weight urges said boat platform in an upper position along said track assembly.

5. The boat hoist of claim 1, wherein said means for moving said boat platform downward along said track assembly includes:

a cable drum;

a cable having a predetermined length having one end windably attached to said cable drum and an opposite end attached over an appropriate pulley arrangement to the lower end of said boat platform.

6. The boat hoist of claim 1, wherein said means for moving said boat platform downward along said track assembly includes:

a cable drum; and a cable having a predetermined length having one end windably attached to said cable drum and an opposite end attached over an appropriate pulley arrangement to a cable connector; and a pair of cables, each having a predetermined length, each having one end attached to said cable connector and each having opposite ends connected over a suitable pulley arrangement to the lower end of said boat platform.

7. The boat hoist of claim 1, wherein said platform is mounted for movement on opposed sets of slotted wheels and said inclined track assembly includes a pair of tracks attached to either side of said frame, said wheel having peripheral slots to accommodate said tracks therein and said tracks in pairs being spaced apart to prevent removal of the wheels therefrom while permitting easy movement up and down said tracks.

8. The boat hoist of claim 1 wherein said means for holding said boat platform at said lower position and at said upper position is provided by a rack bar mounted along said track assembly and weighted pawl movable with said boat platform and adjustably engageable along said rack bar.

9. The boat hoist of claim 1, wherein said platform includes a flotation panel.

* * * * *